US006941097B2

(12) United States Patent
Toba et al.

(10) Patent No.: US 6,941,097 B2
(45) Date of Patent: Sep. 6, 2005

(54) IMAGE FORMING APPARATUS HAVING ROTARY UNIT FOR HOLDING MULTIPLE DEVELOPING DEVICES

(75) Inventors: Shinjiro Toba, Shizuoka (JP); Kazuhiko Kanno, Kanagawa (JP); Jun Shao, Kanagawa (JP); Masahiro Shibata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/662,468

(22) Filed: Sep. 16, 2003

(65) Prior Publication Data

US 2004/0126142 A1 Jul. 1, 2004

(30) Foreign Application Priority Data

Sep. 18, 2002 (JP) ..... 2002-271418

(51) Int. Cl.[7] ..... G03G 15/01
(52) U.S. Cl. ..... 399/227
(58) Field of Search ..... 399/223, 225, 399/224, 227

(56) References Cited

U.S. PATENT DOCUMENTS

| | | | | |
|---|---|---|---|---|
| 4,924,806 A | * | 5/1990 | Mizuno et al. | 399/225 |
| 6,002,898 A | | 12/1999 | Yokomori et al. | 399/119 |
| 6,029,027 A | | 2/2000 | Yokomori et al. | 399/90 |
| 6,061,535 A | | 5/2000 | Yokomori et al. | 399/61 |
| 2003/0133719 A1 | | 7/2003 | Tsuruya et al. | 399/12 |

FOREIGN PATENT DOCUMENTS

| | | | | |
|---|---|---|---|---|
| JP | 56154768 A | * | 11/1981 | G03G/15/09 |
| JP | 7-117783 | | 12/1995 | |
| JP | 8-62923 | | 3/1996 | |
| JP | 8-227211 | | 9/1996 | |
| JP | 11-73012 | | 3/1999 | |
| JP | 2000-227710 | | 8/2000 | |

* cited by examiner

*Primary Examiner*—Susan Lee
(74) *Attorney, Agent, or Firm*—Fitzpatrick, Cella, Harper & Scinto

(57) ABSTRACT

In order to suppress uneven densities in an image, an image forming apparatus includes an image bearing member; a first developing unit, including a first developer carrying member, for developing a first latent image formed on the image bearing member; a second developing unit, including a second developer carrying member, for developing a second latent image formed on the image bearing member after the first developing unit has developed the first latent image; and a rotary unit, for holding the first and the second developing units and for moving the first and the second developing unit to positions opposite said image bearing member. Upon the reception of an image forming signal at the image forming apparatus, the first and the second developer carrying members are rotated before the first latent image on the image bearing member is developed.

7 Claims, 15 Drawing Sheets

IMAGE FORMING APPARATUS HAVING ROTARY UNIT FOR HOLDING MULTIPLE DEVELOPING DEVICES

BACKGROUND OF THE INVENTION

1. Field of the Invention

The present invention relates to an image forming apparatus, such as a copier or a printer, for forming an image on a recording medium using a recording technique, such as an electrophotographic recording method or an electrostatic recording method. In particular, the present invention relates to an image forming apparatus having a rotary unit for holding multiple developing devices.

2. Description of the Related Art

A developing device, which uses toner to develop an electrostatic latent image formed on a photosensitive member, is mounted in an image forming apparatus, such as an electrophotographic copier or printer. Generally, provided for the developing device are a developing roller and a blade for controlling the thickness of a toner layer.

Especially when the image forming apparatus is one for which the developing roller is a flexible roller that is contacted by the blade, if the developing device is not used for an extended period of time, a blade print is formed, and retained, on the developing roller and produces images having uneven densities.

To avoid the deterioration of the developing characteristic due to the blade print, or due to another factor, countermeasures are proposed in JP-A-8-227211, JP-A-2000-227710, JP-A-8-62923, JP-A-11-73012 and JP-B-7-117783. According to these methods, preparative rotation of the developing roller is performed immediately before the developing process is begun, or rotation of the developing roller is started after a predetermined time has elapsed following the completion of the image forming.

When the preparative rotation of a developing roller is performed immediately before the developing, the period before the developing process is started is too short, and complete removal of a blade print can not be expected. Whereas if the performance of the preparative rotation takes too long, the period required for the printing will be extended. Further, if rotation of the developing roller occurs after a predetermined time has elapsed following termination of the image forming, power consumption in the standby state, wherein image forming is not performed, will be increased.

SUMMARY OF THE INVENTION

To resolve the above shortcomings, it is one objective of the present invention to provide an image forming apparatus that can suppress uneven densities in an image.

It is another objective of the present invention to provide an image forming apparatus that can suppress uneven densities in an image while reducing the period required for printing.

It is an additional objective of the present invention to provide an image forming apparatus that can suppress uneven densities in an image while reducing the power consumed in the standby state.

It is a further objective of the present invention to provide an image forming apparatus comprising:

an image bearing member;

first developing means, including a first developer carrying member, for developing a first latent image formed on the image bearing member;

second developing means, including a second developer carrying member, for developing a second latent image formed on the image bearing member after the first developing means has developed the first latent image;

a rotary unit, for holding the first and the second developing means and for moving the first and the second developing means to positions opposite the image bearing member, wherein, upon the reception of an image forming signal at the image forming apparatus, the first and the second bearing members are rotated before the first latent image on the image bearing member is developed.

The other objectives of the present invention will become obvious during the course of the following detailed explanation presented while referring to the accompanying drawings.

DETAILED DESCRIPTION OF THE PREFERRED EMBODIMENT

An image forming apparatus according to one embodiment of the present invention will now be described while referring to the accompanying drawings. In the following explanation, the front face of the apparatus is the face that is upstream in the direction in which a recording material is conveyed from a transferring process section to a fixing process section (right side in FIG. 2), and the left or the right of the main body of the image forming apparatus or a processing cartridge is the left or the right of the front face of the image forming apparatus. The longitudinal direction is the direction in parallel with the surface of the recording medium, and the direction that intersects (is almost orthogonal to) the direction in which the recording medium is conveyed.

(General Configuration of Image Forming Apparatus)

Figure 2:
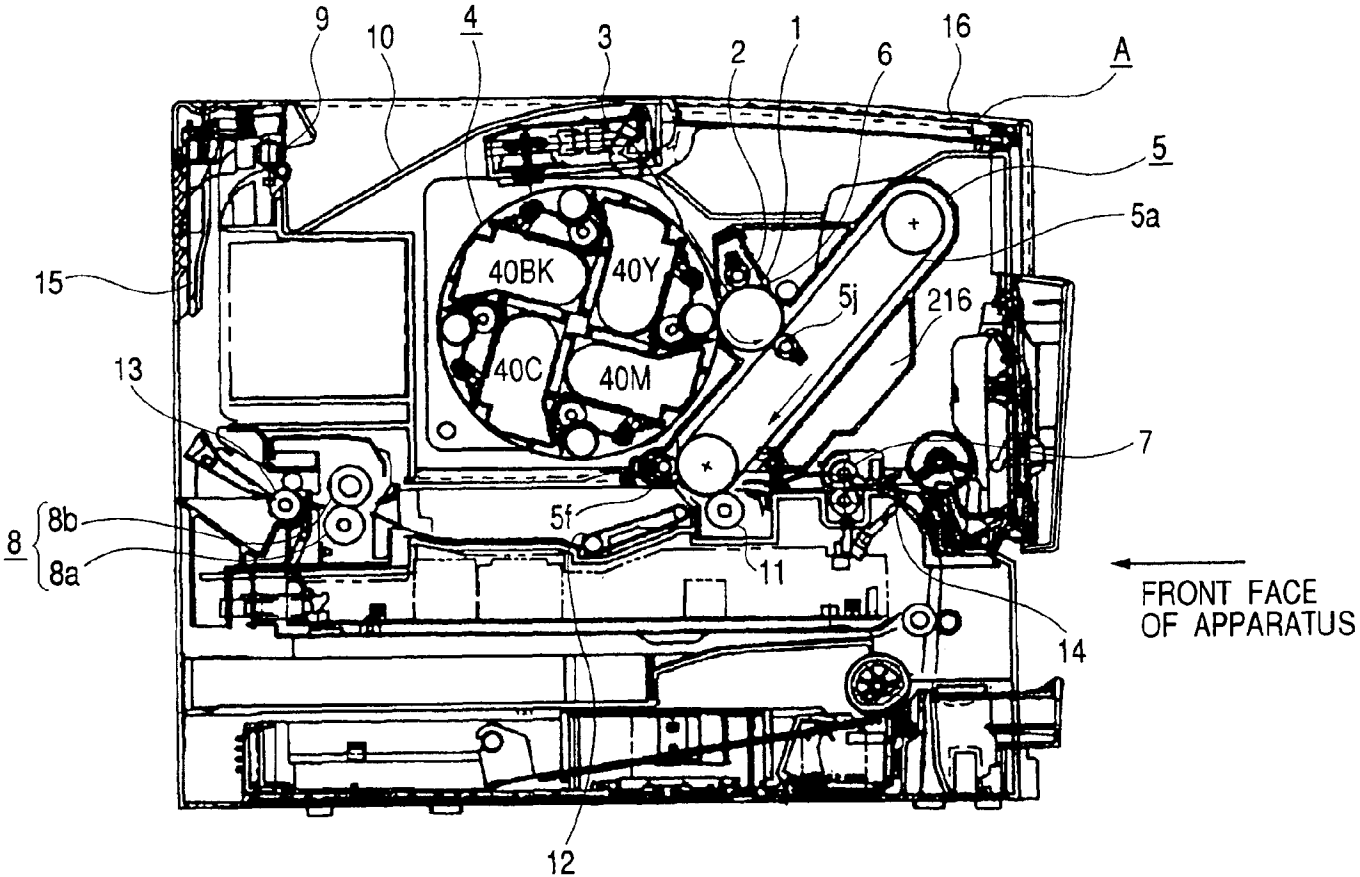
FIG. 2 is a diagram showing the general configuration of an image forming apparatus according to the embodiment.

The general configuration of the image forming apparatus will now be described while referring to FIG. 2. FIG. 2 is a diagram showing the general configuration of the image forming apparatus according to this embodiment, i.e., the schematic arrangement of a color laser beam printer wherein a developing cartridge, a drum cartridge and an intermediate transferring unit are mounted on the main body of the image forming apparatus.

In the image forming apparatus in FIG. 2, based on image data, exposure means 3 emits light onto a photosensitive drum 1, which is an image bearing member, and a developing device 4 develops the optical image on the photosensitive drum 1 to form a developer image (hereinafter referred to as a "toner image"). Then, synchronized with the formation of the toner image, a recording material is conveyed by conveying means, and the toner image formed on the photosensitive drum 1 is transferred to an intermediate transferring belt 5*e*, which is an intermediate image bearing member. Then, the toner image on the intermediate transferring belt 5*a* is transferred to the recording material by secondary transferring means, and the recording material is conveyed to a fixing device 8 including a pressurizing roller 8*a* and a heating roller 8*b*. The transferred toner image is fixed to the recording material, and the resultant recording material is then discharged, by a discharging roller pair 9, to a discharge tray 10.

The image forming processing will now be described more in detail.

The photosensitive drum 1 is rotated in a direction indicated by an arrow in FIG. 2 (counterclockwise) in synchronization with the rotation of the intermediate transferring belt 5*a*, and the surface of the photosensitive drum 1 is uniformly electrified by a charging roller 2. Further, the exposure means 3 emits light for a yellow image, for example, and forms on the photosensitive drum 1 an electrostatic latent image corresponding to the yellow image.

The exposure processing is performed in the following manner. The exposure means 3 emits light, based on image data read from an external device, to form an optical image on the photosensitive drum 1, and for this purpose, includes a laser diode, a polygon mirror, a scanner motor, a focusing lens and a reflection mirror.

When the exposure means 3 receives an image signal from an external device, pursuant to this image signal the laser diode emits light as an optical image onto the polygon mirror. The polygon mirror, which is rapidly rotated by the scanner motor, reflects the image light, and the surface of the photosensitive drum 1 is selectively exposed to light that has passed through the focusing lens and has been reflected by the reflection mirror. As a result, the electrostatic latent image is formed on the photosensitive drum 1. In the same manner as is employed for the formation of the electrostatic latent image, a rotary developing device 4 is rotated to move a yellow developing cartridge 40Y to a developing position, and to obtain a yellow toner image, yellow toner is attached to the electrostatic latent image by the application of a predetermined bias voltage. Thereafter, a bias voltage having a polarity opposite to that of the toner is applied to a primary transferring roller 5*j*, which is internally provided for the intermediate transferring belt 5*a*, and the yellow toner image on the photosensitive drum 1 is transferred to the intermediate transferring belt 5*a*.

When the primary transfer of the yellow toner image has been completed, the next developing cartridge 40 is rotated and positioned facing the photosensitive drum 1. Thereafter, the above described processing is repeated for the individual colors magenta, cyan and black, and four toner color images are superimposed on the intermediate transferring belt 5*a*. During this period, a secondary transferring roller 11 does not contact the intermediate transferring belt 5*a*. Also, at this time, a cleaning charging roller 5*f* serving as a cleaning unit is positioned so that it does not contact the intermediate transferring belt 5*a*.

After the four-color toner image has been formed on the intermediate transferring belt 5*a*, the secondary transferring roller 11 is brought into contact with the intermediate transferring belt 5*a*. Further, synchronized with this contact effected by the secondary transferring roller 11, the recording material, on standby at a predetermined location near a registration roller pair 7, which is feeding means, is transferred to the nip portion between the intermediate transferring belt 5*a* and the secondary transferring roller 11. Located immediately before the registration roller pair 7 is a pre-registration sensor 14, for detecting the leading edge of the recording material and blocking the rotation force of the registration roller pair 7, and for holding the recording material in the standby state at the predetermined location. A bias voltage having a polarity opposite that of the toner is applied to the secondary transferring roller 11, and the toner images on the intermediate transferring belt 5*a* are collectively transferred to the surface of the recording material as it is conveyed. The recording material to which the secondary transfer of the toner image has been effected is conveyed through a conveying belt unit 12 to the fixing device 8 to fix the toner image to the recording material. Thereafter, the resultant recording material is conveyed along a discharge guide 15 by a discharge roller pair 13, and is discharged by a discharge roller pair 9 to the discharge tray 10 located in the upper portion of the main body of the image forming apparatus. The image forming processing is thus completed.

Subsequently, after the secondary transfer has been completed, the cleaning charging roller 5*f* is brought into contact with the intermediate transferring belt 5*a*, and a predetermined bias voltage is applied to the surface of the intermediate transferring belt 5*a* to de-electrify the toner remaining on the intermediate transferring belt 5*a*. Thereafter, at the primary transfer nip portion, the de-electrified residual toner is again electrostatically transferred, from the intermediate transferring belt 5*a* to the photosensitive drum 1, and as a result, the surface of the intermediate transferring belt 5*a* is cleaned. Thus, after the secondary transfer has been performed, the residual toner, which has been transferred to the photosensitive drum 1, is removed and collected by a cleaning blade 6 provided for the photosensitive drum 1. Following this, the thus collected residual toner is carried as waste toner along a carrying path, which will be described later, and is delivered to and accumulated in a waste toner box 216.

(Detachment Arrangement for Developing Cartridge 40)

Figure 3:
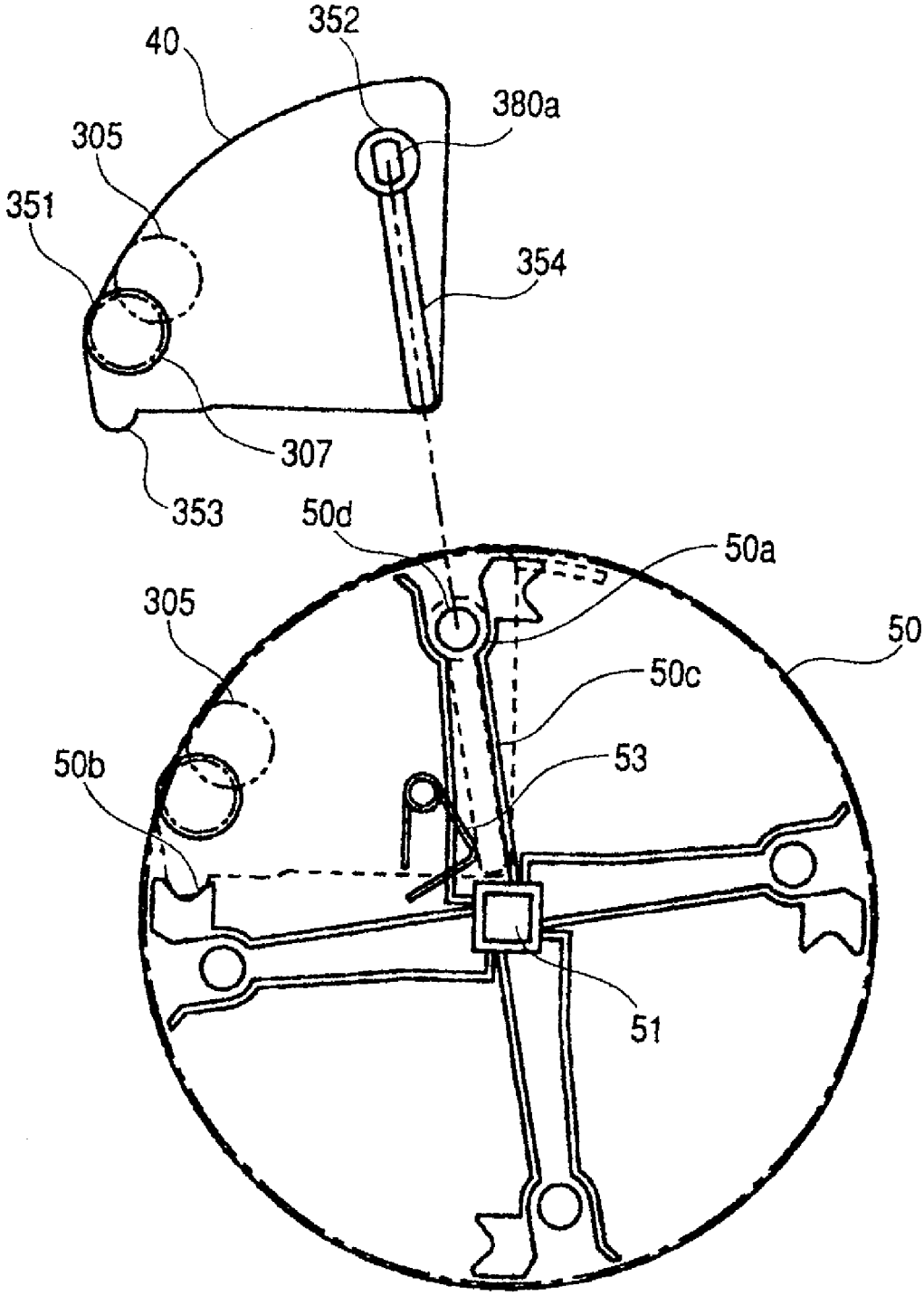
FIG. 3 is a side view of a developing cartridge to be attached to a rotary unit.
Figure 4:
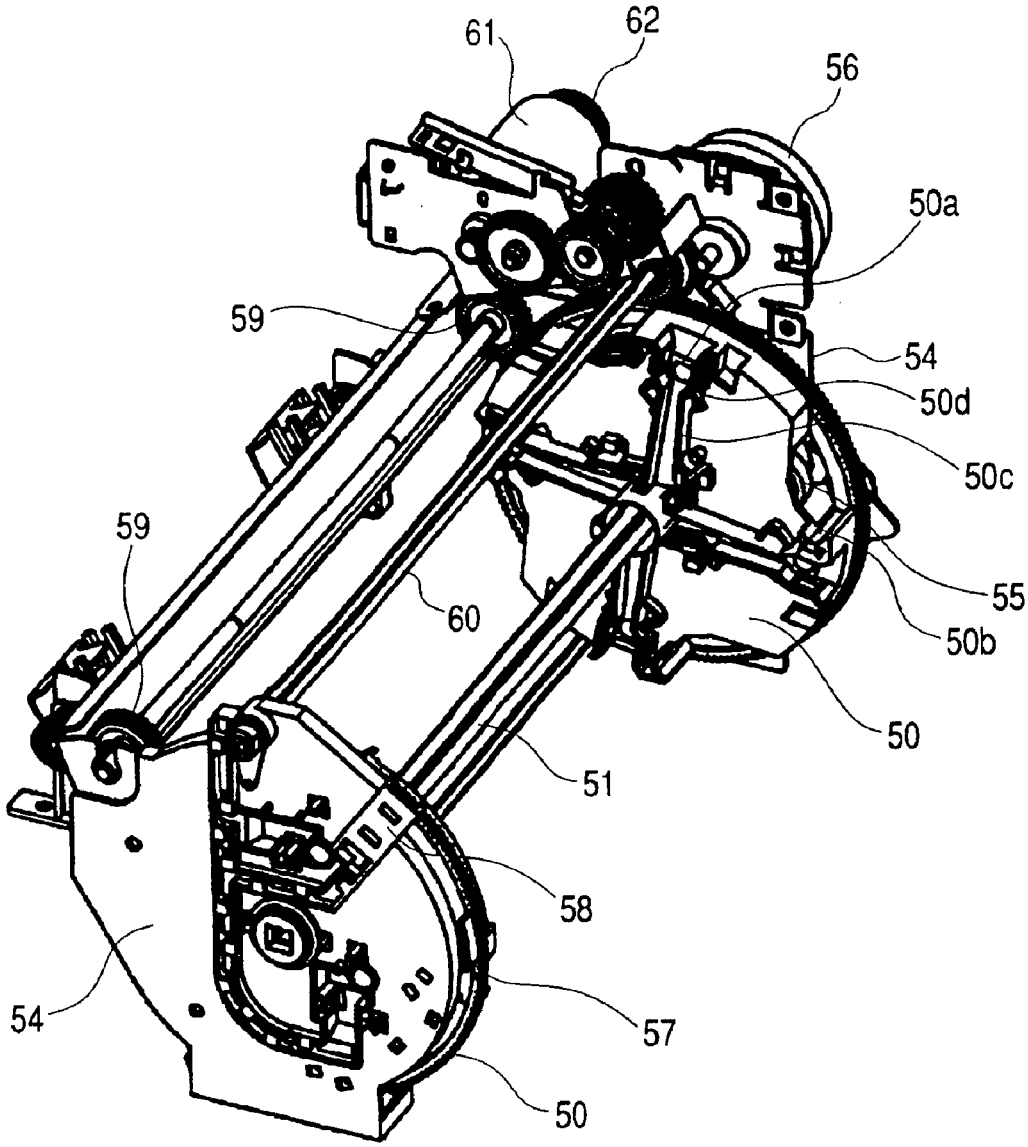
FIG. 4 is a perspective view of the rotary unit.
Figure 5:
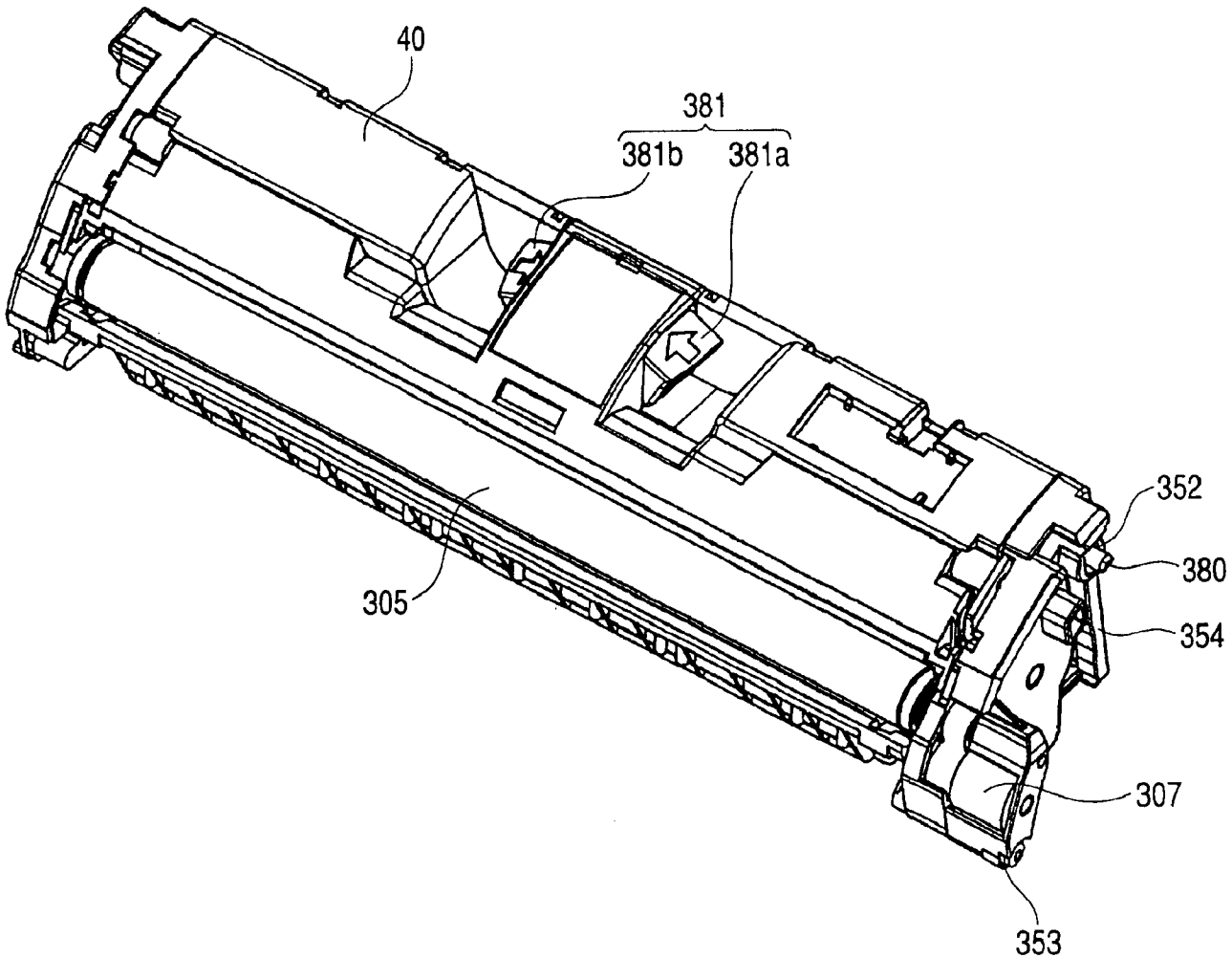
FIG. 5 is a perspective view of the developing cartridge.
Figure 6:
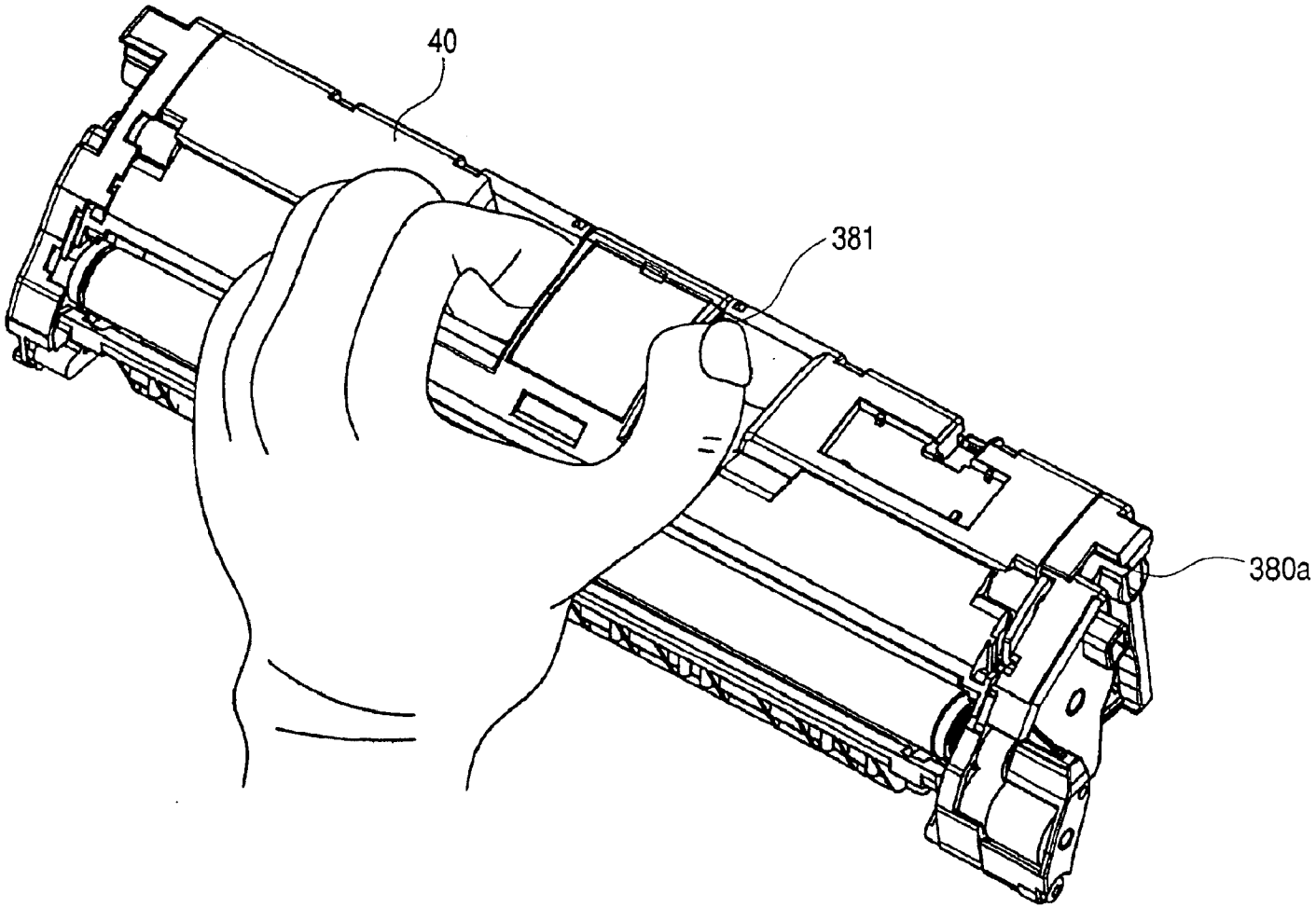
FIG. 6 is a perspective view of the state wherein the developing cartridge is gripped.
Figure 7:
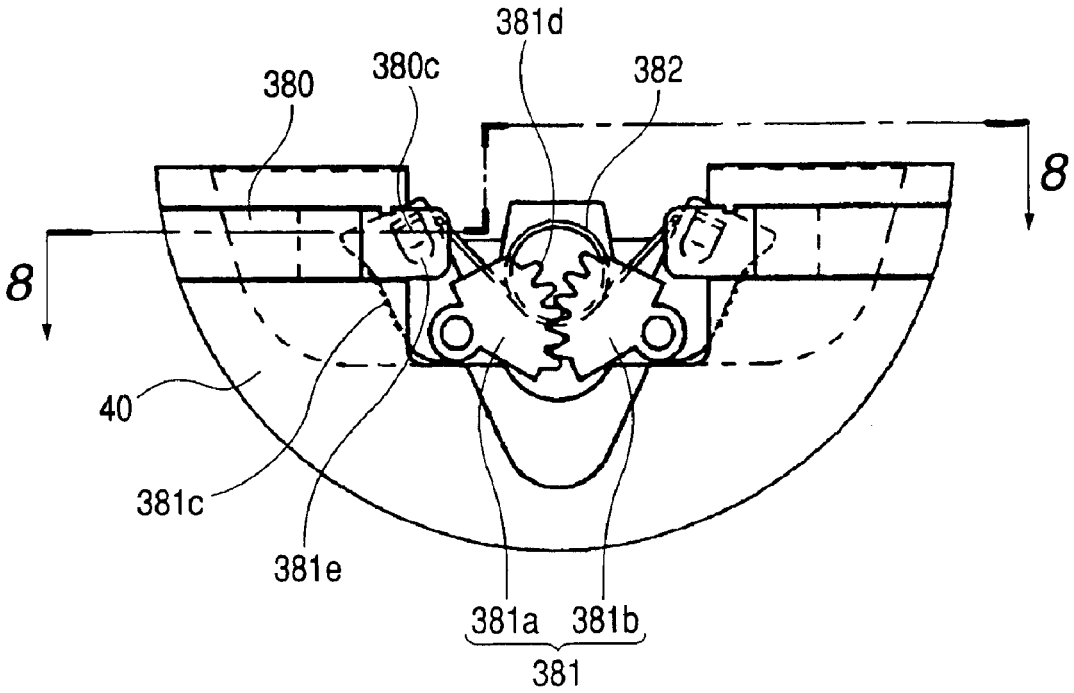
FIG. 7 is a detailed diagram showing a handle portion.

The developing cartridge 40, in which individual toner colors, black, magenta, cyan and yellow, are stored, is fixed in a predetermined position within the rotary unit. The method used for positioning the developing cartridge 40 in the rotary unit will now be described in detail while referring to FIGS. 3 to 10. FIG. 3 is a side view of the attachment of the developing cartridge to the rotary unit. FIG. 4 is a perspective view of the rotary unit. FIGS. 5 and 6 are perspective views for explaining the developing cartridge. FIG. 7 is a detailed diagram showing a handle portion. FIG.

Figure 9:
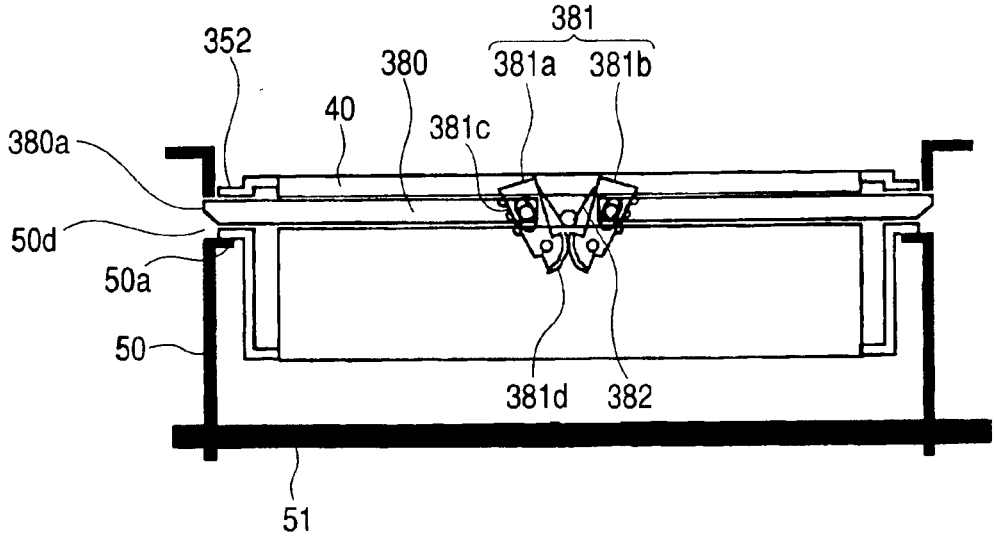
FIG. 9 is a front cross-sectional view of the developing cartridge attached to the rotary unit.
Figure 10:
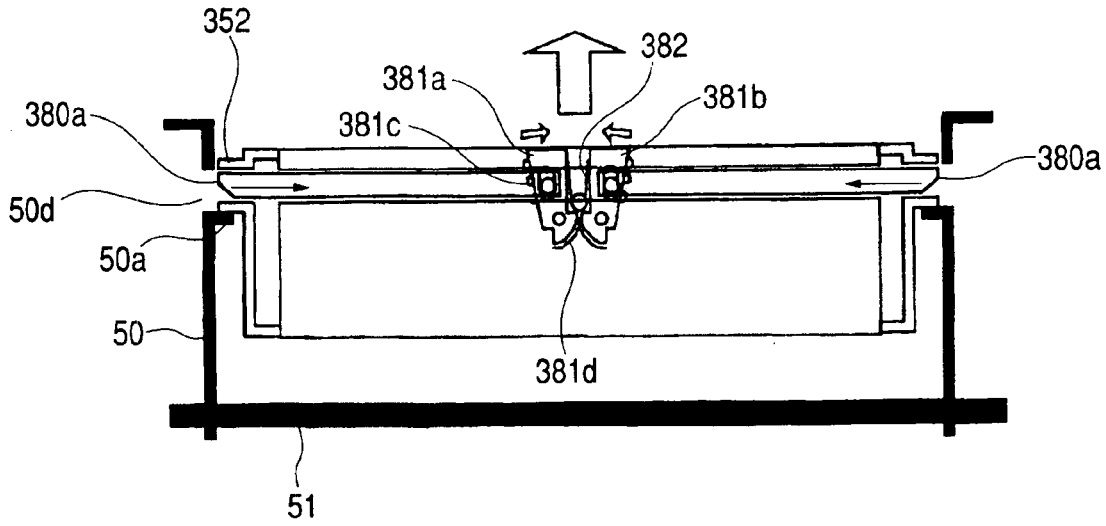
FIG. 10 is a front cross-sectional view of the developing cartridge to be detached from the rotary unit.

8 is a top cross-sectional view taken along line 8—8 in FIG. 7. FIG. 9 is a front cross-sectional view of the state when the developing cartridge is attached to the rotary unit. FIG. 10 is a front cross-sectional view of the state when the developing cartridge is to be detached from the rotary unit.

As is shown in FIG. 4, the rotary unit is rotated at a center shaft 51, and fixed disk-shaped rotary flanges 50 are located at both sides of the center shaft 51. Formed for the rotary flanges 50 are guide grooves 50*c* along which the developing cartridge 40 is guided for detachment, first receptacles 50*a* constituting the centers for the positioning of the developing cartridge 40, and second receptacles 50*b* for halting the rotation of the developing cartridge 40. Holes 50*d* are formed in the longitudinal side faces of the first receptacles 50*a* along the positioning center axis. And as will be described later, the holes 50*d* serve as hooks for preventing the dropping of the developing cartridge 40.

Whereas guide ribs 354 along which the developing cartridge 40 is guided while being detached, first arc-shaped projections 352, which are the centers for positioning the developing cartridge 40, and second arc-shaped protrusions 353, which halt the rotation of the developing cartridge 40, are formed on the side faces of the developing cartridge 40.

Further, movable protrusions 380*a* that can be extended or retracted project longitudinally from the ends of the first protrusions 352. As is shown in FIG. 9, the movable protrusions 380*a* are formed at the ends of sliders 380, which are rod members, the length of each is about half the longitudinal length of the developing cartridge 40. When the sliders 380 are moved along the guide groove formed in the rear face of the developing cartridge 40, at the ends of the first protrusions 352, the movable protrusions 380*a* are extended or retracted. As is shown in FIG. 8, steps 40 are formed for the guide groove while steps 380*d* are also formed for the sliders 380, and the movements of the sliders 380 are regulated by the abutting, upon each other, of these steps.

A hinge handle 381 is provided near the longitudinal center of the developing cartridge 40, and is urged upward by a torsion coil spring 382 so that it is always open.

Figure 8:
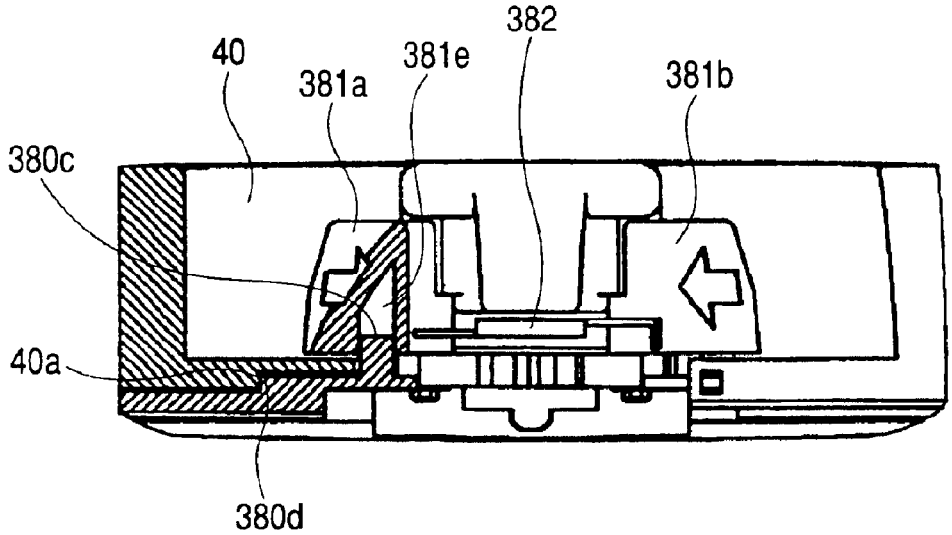
FIG. 8 is a top cross-sectional view taken along line 8—8 in FIG. 7.

The hinge handle 381 is constituted by a pair of hinge members 381*a* and 381*b* in which, as is shown in FIGS. 7 and 8, long holes 381*e* are formed in the side faces. On the other hand, protrusions 380*c* are formed on the ends of the sliders 380, opposite the ends wherein the protrusions 380*a* are formed, and are fitted to the long holes 381*e*. With this arrangement, the sliders 380 are moved, interlocked with the opening and closing of the hinge handle 381.

In the normal state, the hinge handle 381 is urged upward by the torsion coil spring 382 and is open, and the protrusions 380*a* on the sliders 380 are projected from the end faces of the first protrusions 352. When the hinge handle 381 is gripped, it closes, and the protrusions 380*a* on the sliders 380 are retracted from the end faces of the first protrusions 352.

Furthermore, multiple slip stop ribs 381*c*, 0.5 mm high, are formed on the side faces of the hinge handle 381, where they are to be gripped, so that, as is shown in FIG. 6, the developing cartridge 40 will not slip while it is being carried by the hinge handle 381. Further, the side faces of the hinge handle 381 are slightly formed thinner, so that when the hinge handle 381 is closed, the side faces thereof are slightly undercut.

In addition, as is shown in FIG. 10, for the hinge members 381*a* and 381*b*, gear teeth 381*d* are formed on the sides at the rotary portion opposite to the sides where the hinge handle 381 is gripped. Since these gear teeth 381*d* are engaged, only one of the hinge members 381*a* and 381*b* need be closed, for the other hinge member to be closed and both sliders 380 moved at the same time. With this structure, the developing cartridge 40 can be stably inserted into or detached from the rotary flanges 50, while both sides of the developing cartridge 40 can be manipulated at the same time, without one side of the developing cartridge 40 being caught by the rotary flange 50, or slipping off.

For the insertion of the developing cartridge 40, the guide ribs 354 formed in the two side faces of the developing cartridge 40 are aligned with the guide grooves 50*c* of the rotary flanges 50 by gripping the hinge handle 381. And when the first arc-shaped protrusions 352 formed on the side faces of the developing cartridge 40 abut against the first receptacles 50*a* on the side faces of the rotary flanges 50, the hinge handle 381 is released. Then, the movable protrusions 380*a* are extended from the end faces of the first protrusions 352, and are fitted into the hook holes 50*d* that are formed on the longitudinal side faces of the first receptacles 50*a* (see FIG. 9).

Since the first protrusions 352 and the movable protrusions 380*a* are coaxially formed, the developing cartridge 40 can be pivoted at the first protrusions 352. Urging springs 53 are formed along the guide grooves 50*c* of the rotary flanges 50 to rotate the developing cartridge 40 counterclockwise, as viewed from the paper face. With these urge springs 53, the second protrusions 353 of the developing cartridge 40 are brought closely into contact with the second receptacles 50*b* of the rotary flanges 50, so that the developing cartridge 40 can be fixed in its position. Therefore, the developing cartridge 40 can be precisely secured in the normal position relative to the rotary flanges 50, and the image forming process will provide an image having an even density.

For the removal of the developing cartridge 40, as is shown in FIG. 10, by gripping the hinge handle 381, the movable protrusions 380*a* are retracted and disengaged from the hook holes 50*d*, thereby permitting the developing cartridge 40 to be removed upward.

With the above described configuration, the user need only grip the hinge handle 381 to disengage the developing cartridge 40, and the required manipulations can intuitively and easily be understood. Further, since a spring for preventing the dropping of the developing cartridge is not required, the load imposed by the detachment of the developing cartridge can be almost eliminated. Furthermore, since the configuration is simple, failures seldom occur and the production costs can be reduced.

In addition, since the hinge handle 381 is located near the longitudinal center of the developing cartridge 40, the labor required of a user to carry the developing cartridge 40 can also be reduced. Moreover, since the developing cartridge 40 is balanced at both ends, the detachment of the developing cartridge 40 can be smoothly performed using one hand.

(Structure for Driving Developing Cartridge 40)

The structure for driving the developing cartridge 40 will be described in detail while referring to FIGS. 4 and 11. Rotary side plates 54 are arranged on the outer sides of the rotary flanges 50, and a center shaft 51 is fitted that penetrates the rotary flanges 50 and the rotary side plates 54. In other words, the rotary flanges 50 and the center shaft 51 are rotatably supported by the rotary side plates 54. Multiple gears are fixed on one of the rotary side plates 54. An input gear 307 for the developing cartridge 40 (gear located on one longitudinal end of a developing roller 305) engages an end gear 55, which is the furthest downstream in the gear train provided for the rotary side plate 54, and rotates the developing roller 305, which is a developer carrying member, a coating roller and an agitating member, for example.

In this embodiment, when the developing cartridge 40 is moved and positioned near the end gear 55 as the rotary flanges 50 are rotated, the input gear 307 engages the end gear 55 of the rotary side plate 54. At this time, there is a probability that, when the developing cartridge 40 is pivoted by the revolution of the rotary unit, the teeth of the end gear 55 of the rotary side plate 54 will strike against the teeth of the input gear 307 of the developing cartridge 40 and the teeth will not be correctly engaged. In order to ensure the engagement of these gears, in this embodiment, the developing cartridge 40 is pivoted at the first receptacles 50*a* of the rotary flanges 50 and is temporarily retracted, so that the teeth of the gears are securely engaged. More specifically, when the teeth of the end gear 55 of the rotary side plate 54 strike the teeth of the input gear 307 of the developing cartridge 40, due to the impact, the developing cartridge 40 pivots slightly, in the radial direction of the rotary unit, at the first receptacles 50*a* of the rotary flanges 50. This movement of the developing cartridge 40 cancels the effect produced by the collision between the teeth, and the urging springs 53 of the rotary flanges 50 position the developing cartridge 40 at a predetermined location.

Further, when the developing cartridge 40 has been positioned and is to be rotated to the next location, and when the engagement of the rotary flange 50 with the end gear 55 can not be released, the mechanism for pivoting the developing cartridge 40 can disengage the developing cartridge 40 and the rotary flanges 50 from the end gear 55.

Figure 11:
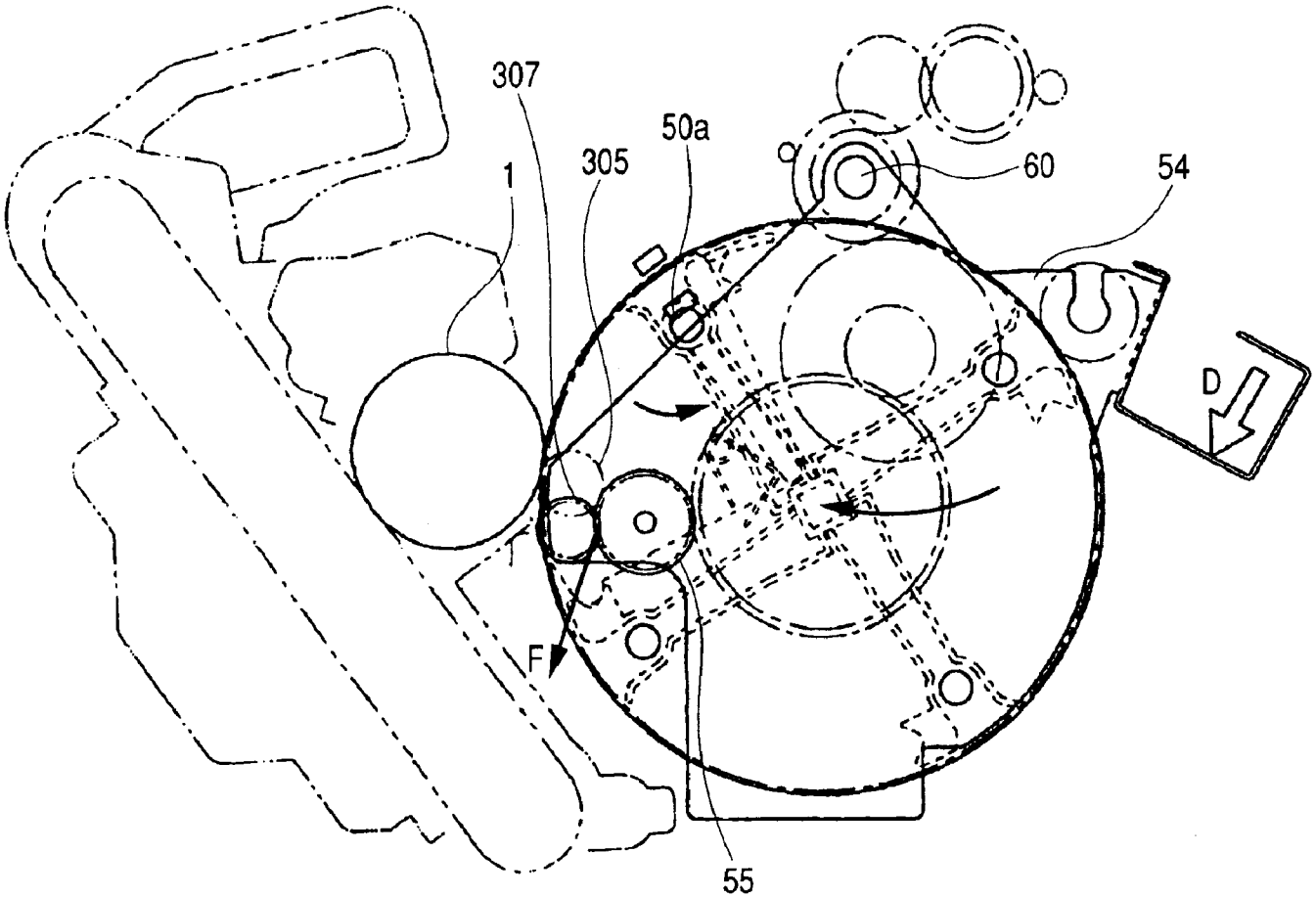
FIG. 11 is a diagram for explaining the arrangement for driving the developing cartridge.

The input gear 307 of the developing cartridge 40 receives, from the end gear 55 of the rotary side plate 54, an engagement force F in the direction indicated by an arrow in FIG. 11. Using the engagement force F, a counterclockwise rotation moment at the first receptacles 50*a* of the rotary flanges 50 is exerted on the developing cartridge 40. Due to the rotation moment, the second protrusions 353 of the developing cartridge 40 are pressed against the second receptacles 50*b* of the rotary flanges 50, so that during the driving operation, the developing cartridge 40 is prevented from being moved away from the positioning portions of the rotary flanges 50. Since the engagement force F constitutes a closed force system within the rotary unit, almost no affect is produced by the force of the pressure exerted by the developing cartridge 40 on the photosensitive drum 1, which will be described later.

(Structure for Urging Developing Cartridge 40)

In this embodiment, developing cartridges 40 for four colors are loaded into the rotary unit. The pressing of the developing cartridges 40 against the photosensitive drum 1 is performed as follows. While, as is described above, the rotary flanges 50 are supported so they are rotatable by the rotary side plates 54, the rotary side plates 54 on both sides of the rotary unit are positioned and fixed to the side plates of the main body of the image forming apparatus by a pivot shaft 60, which is rotatably arranged above the rotary side plates 54 and in parallel with the center shaft 51. In other words, the developing cartridge 40, the rotary flanges 50 and the rotary side plates 54 are pivoted as one. That is, as the developing cartridge 40 and the rotary unit are rotated, the developing cartridge 40, or more accurately, the developing roller 305, is pushed against or separated from the photosensitive drum 1. This process is performed when a rotary stay fixed to the rotary side plate 54 is pushed up by the rotation of a cam (not shown).

(Control of Rotation of Rotary Unit)

As is shown in FIG. 4, the outer faces of the rotary flanges 50 are gear-toothed, and a pair of follower gears 59 are so arranged that they engage them. The follower gears 59 are coupled by a rotary shaft, so that when one of the follower gears 59 rotates a rotary flange 50, the other rotary flange 50 is rotated, at the same phase, by the other follower gear 59. This structure protects the rotary flanges 50 from being twisted while they are being revolved, or while the developing roller 305 is being driven.

Rotary drive gears for rotating the rotary flanges 50 are fitted over the pivoting center of the rotary side plate 54, i.e., a pivot shaft 60, and are connected to a rotary drive motor 61. A well known encoder 62 is fitted around the end of the rotary shaft of the rotary drive motor 61 to detect the degree of rotation of the rotary drive motor 61 and to control the number of rotations. In addition, a flag 57 projects outward, toward the side, from the outer face of one of the rotary flanges 50, and is rotated and passes through a photointerrupter 58 that is fixed to the rotary side plate 54.

In this embodiment, the time whereat the flag 57 passes through the photointerrupter 58 is employed as a reference, and the rotary unit is pivoted at a predetermined angle. Naturally, to control the revolution angle, the encoder 62 detects the degree of rotation. Conventionally, when the degree of rotation of the rotary unit is controlled by a pulse motor, high-frequency rasping noise may occur due to excitation. However, since in this embodiment a DC motor is employed to control the rotary unit, the rotary unit can be driven more quietly.

(Structure of Developing Cartridge 40)

Figure 12:
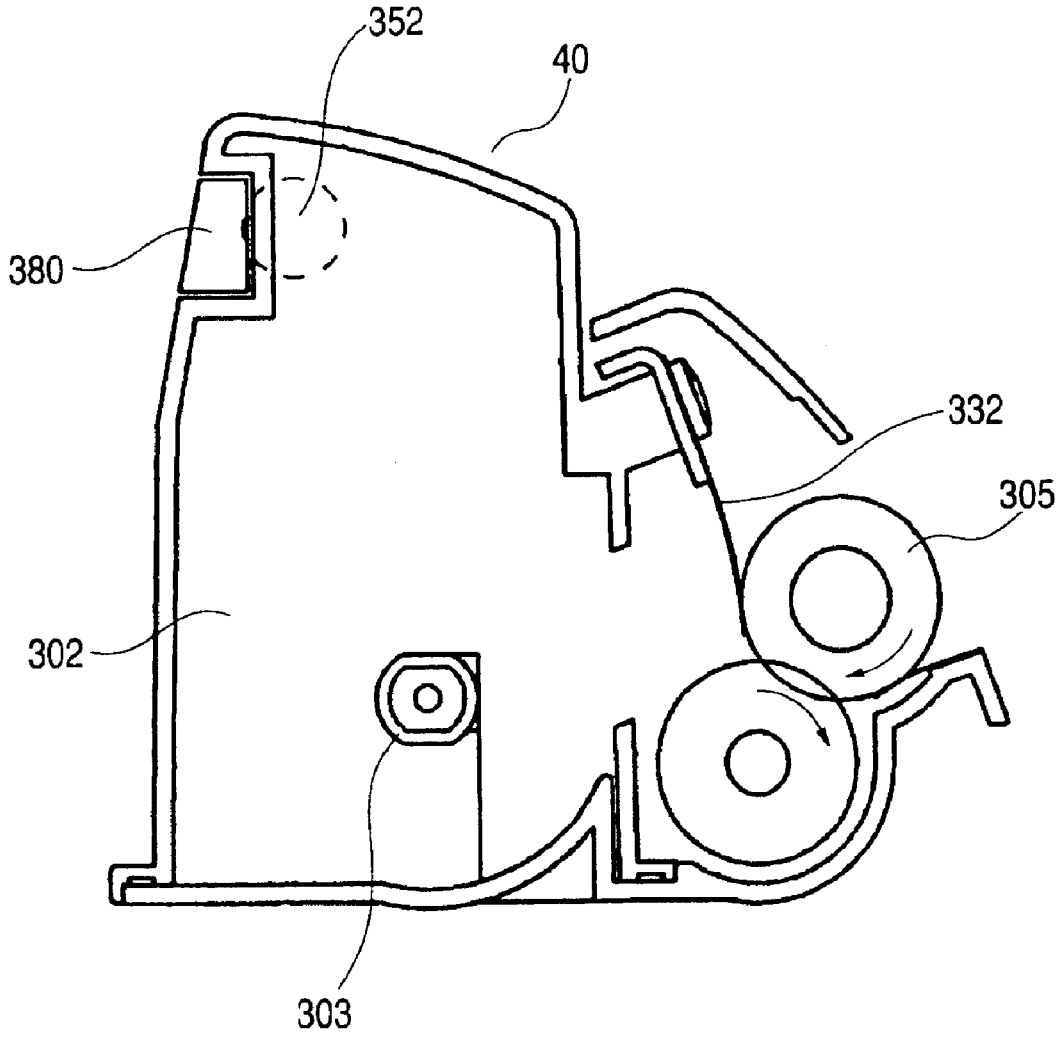
FIG. 12 is a diagram for explaining the structure of the developing cartridge.

The structure of the developing cartridge 40 will now be described while referring to FIG. 12. The developing cartridge 40 is roughly divided into a toner storage portion 302 and a developing portion. The toner storage portion 302 is filled with toner having a predetermined color, and as agitating means 303 is rotated, a predetermined amount of the toner is carried to the developing portion. The toner carried to the developing portion is supplied to the surface of the developing roller 305 by the rotation of a toner supplying roller 304, composed sponge. Further, the toner is charged and deposited as a thin layer by the friction between a thin-plate developing blade 332 and the developing roller 305. The toner layer on the developing roller 305 is carried to the developing portion as the developing roller 305 is rotated, and upon the application of a predetermined developing bias, a visualization process is performed to form, as a toner image, an electrostatic latent image on the photosensitive drum 1.

The residual toner that is not employed for the visualization of the latent image on the photosensitive drum 1, i.e., the undeveloped toner remaining on the developing roller 305, is scraped off by the toner supplying roller 304, while at the same time, new toner is supplied to the developing roller 305. Thus, the developing operation is continuously performed.

(Structure of Processing Cartridge 5)

Figure 13:
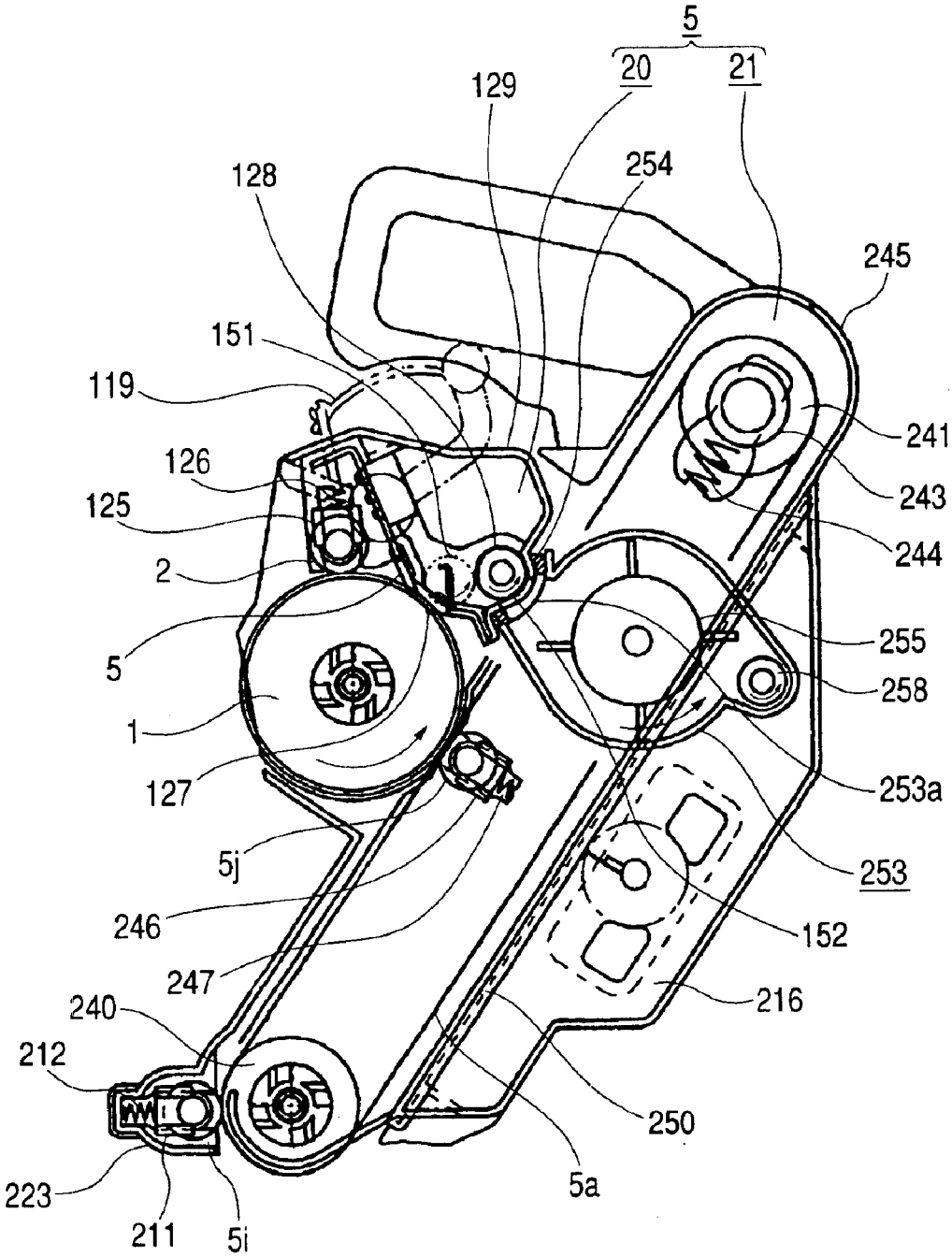
FIG. 13 is a vertical left-side cross-sectional view of a processing cartridge.
Figure 14:
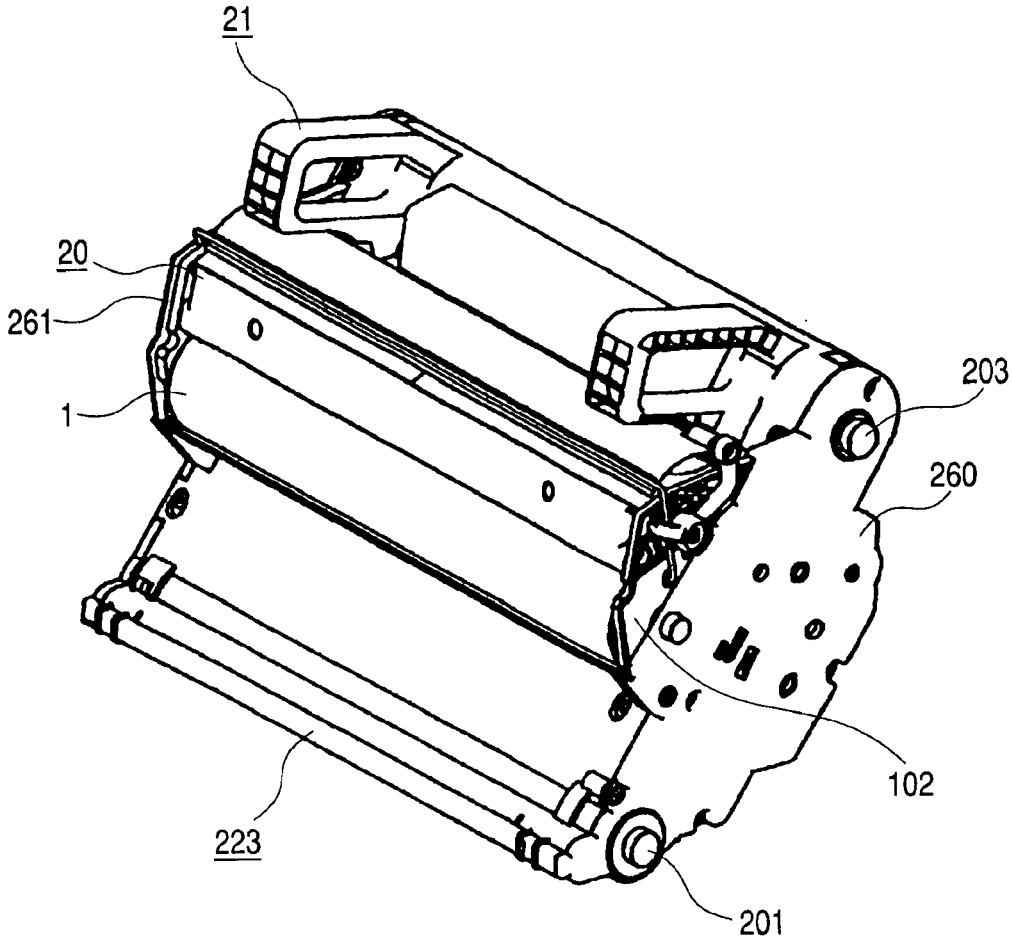
FIG. 14 is a left-side perspective view of the processing cartridge.
Figure 15:
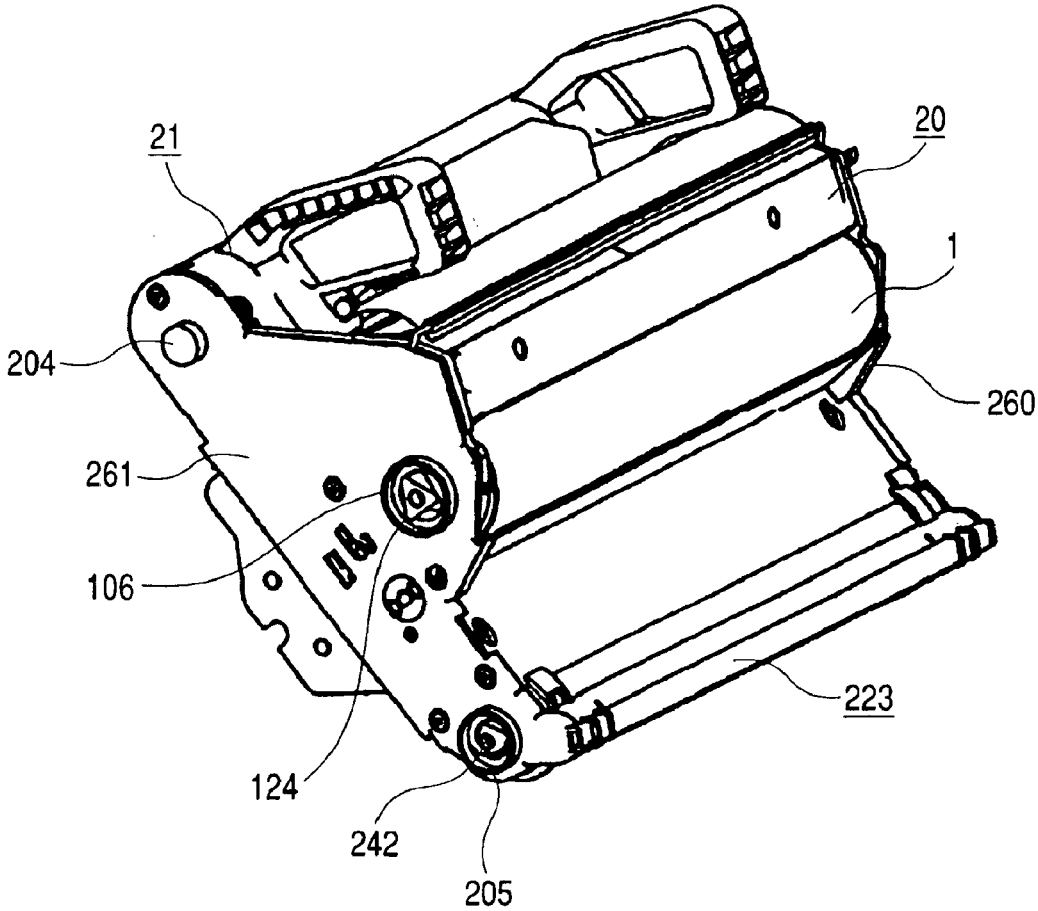
FIG. 15 is a right-side perspective view of the processing cartridge.
Figure 16:
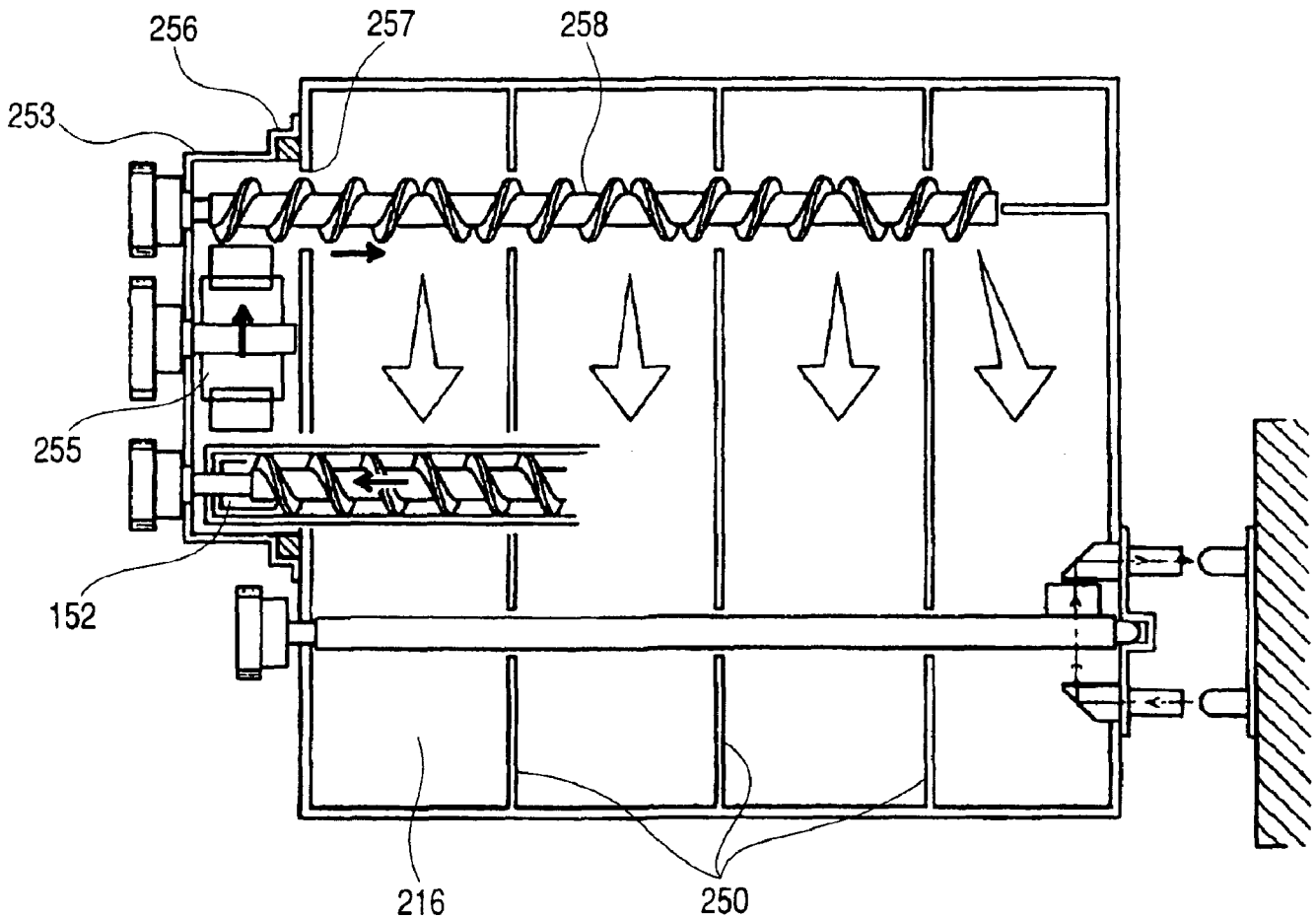
FIG. 16 is a diagram for explaining waste toner collection and storage means.

In this embodiment, the portion including the photosensitive drum 1, the intermediate transferring belt 5*a* and the waste toner box 216 constitutes an integral-type processing cartridge 5. FIG. 13 is a vertical side cross-sectional view of the processing cartridge 5; FIG. 14 is a left side perspective view of the processing cartridge 5; FIG. 15 is a right side perspective view of the processing cartridge 5; and FIG. 16 is a diagram for explaining waste toner collection and storage means. The processing cartridge 5 is constituted by two units: a photosensitive drum unit 20, including the photosensitive drum 1, and an intermediate transferring unit 21, including the intermediate transferring belt 5*a* and the waste toner box 216. The photosensitive drum unit 20 is located upward, above the intermediate transferring unit 21 in the projection direction, and side plates 260 and 261 of the intermediate transferring unit 21 are extended to the two sides of the photosensitive drum unit 20 to hold the photosensitive drum unit 20 away from the sides.

(Structure of Photosensitive Drum Unit 20)

In the photosensitive drum unit 20, the two ends of the photosensitive drum 1 are rotatably supported by a right bearing 106 and a left rotary shaft 102, and a predetermined rotation force is transmitted from the main body of the apparatus through a coupling 124 located at the left end. Further, a predetermined force, exerted by a compression spring 126 through bearings 125 located at both ends, presses the charging roller 2 against the photosensitive drum 1 so that the photosensitive drum 1 is rotated while coupled with the charging roller 2. At least one of the bearings 125 is made of a conductive material, and upon the application of a predetermined bias charge voltage to the charging roller 2, the surface of the photosensitive drum 1 is uniformly electrified. The photosensitive drum 20 also includes a drum shutter 119 that is driven, and opened or closed, by a lever 120*c* that interacts with the operation for detaching the photosensitive drum unit 20 from the image forming apparatus.

Further, for the photosensitive drum 1, the cleaning blade 6 is arranged at a predetermined position to collect, on the surface of the photosensitive drum 1, the toner remaining on the intermediate transferring belt 5*a*, and to scrape off this toner, together with the residual toner on the photosensitive drum 1. A dip sheet 127 prevents the waste toner from dropping onto the intermediate transferring belt 5*a* while it is being scraped, and as a feeding vane 151 is rotated, the residual toner retained between the cleaning blade 6 and the dip sheet 127 is discharged to the rear, into a photosensitive drum container 129, i.e., in the direction opposite of that to the photosensitive drum 1. When a first screw 128 that is located to the rear of the feeding vane 151 is rotated, as viewed from the front face of the apparatus (forward in FIG. 13), the waste toner is carried to the left.

In the photosensitive drum container 129, an opening 152 is formed at the bottom at the left end of the groove portion wherein the first screw 128 is located. The waste toner is carried to the left end by the first screw 128 and falls through the opening and is carried to a reservoir 153*a* for the intermediate transferring unit 21. A seal member 254 is provided under the opening 152 to prevent the toner from leaking from the joint at the reservoir 153*a*.

(Structure of Intermediate Transferring Unit 21)

The structure of the intermediate transferring unit 21 will now be described. The intermediate transferring unit 21 comprises means for transferring, to a recording material, an image that has been transferred from the photosensitive drum 1 by the intermediate transferring belt 5*a*; and means for collecting and storing waste toner. The individual means constituting the intermediate transferring unit 21 will be described below.

(Intermediate Transferring Means)

The intermediate transferring belt 5*a* is put around an intermediate transferring frame 245 and is extended between a driving roller 240 and a follower roller 241. The driving roller 240 is rotatably supported at both ends by a right bearing 205 and a left bearing 201, and receives from the main body of the apparatus, through a coupling 242 located at the right end, a predetermined rotational force. A compression spring 244, arranged for bearings 243 at both ends of the follower roller 241, exerts a driving force that provides a predetermined tension for the intermediate transferring belt 5*a*. The primary transferring roller 5*j*, which is located at a position opposite the photosensitive drum 1 with the intermediate transferring belt 5*a* in between, is pressed against the photosensitive drum 1 by a compression spring 247, through bearings 246 provided at both ends of the roller 5*j*, and the two are rotated together. At least one of the bearings 246 is made of a conductive material, and upon the application of a predetermined bias transferring voltage to the primary transferring roller 5*j*, the primary transferring process is performed and the toner on the surface of the photosensitive drum 1 is transferred to the intermediate transferring belt 5*a*.

Further, a cleaning charging roller portion 223 is located at a position opposite the driving roller 240, along the intermediate transferring belt 5*a*, and applies a predetermined bias voltage to the toner remaining on the intermediate transferring belt 5*a* to remove the residual charge. The cleaning charging roller 5*f* is pressed against the driving roller 240 by a compression spring 212, through bearings 211 located at both ends of the roller 5*f*, and is rotated with it. At least one of the bearings 211 is made of a conductive material, and upon the application of a predetermined bias voltage to the cleaning charging roller 5*f*, a residual charge is removed from the toner. The residual toner is then electrostatically transferred to the photosensitive drum 1, and is removed and collected by the cleaning blade 6 and stored in the waste toner box 216, as is described above.

(Waste Toner Collecting and Storing Means)

In the intermediate transferring unit 21, the waste toner box 216 is provided on the side opposite the photosensitive drum unit 20 with the intermediate transferring belt 5*a* in the center. As is shown in FIG. 16, the waste toner box 216 is shaped like a box by bonding partition walls 250 to a portion of the intermediate transferring frame 245, to ensure that the toner remaining on the photosensitive drum 1 is finally stored in the waste toner box 216.

An impeller cover 253 is bonded to the left side of the intermediate transferring frame 245 with a sealing member 256 sandwiched in between. An opening 253*a* is formed in the impeller cover 253, with the sealing member 254 sandwiched in between, that communicates with the opening 152 that is formed in the lower left end of the photosensitive drum container 129. In this arrangement, the waste toner falls through the opening 152 and is accumulated inside the impeller cover 253. Within the impeller cover 253, an impeller 255 is rotated counterclockwise, as viewed from the left side, and carries the waste toner retained inside the impeller cover 253 toward a waste toner box 216. The impeller cover 253 overlaps the left side face of the waste toner box 216, and in the overlapped portion, a hole 257 is formed that communicates with the inside of the impeller cover 253.

Further, a second screw 258 is arranged at a position extending longitudinally from the hole 257, and as the second screw 258 is rotated, the waste toner that is carried by the impeller 255 is carried further from the left of the waste toner box 216 toward the right rear. Inside the waste toner box 216 several chambers are defined by multiple partition walls 250, perpendicular to the second screw 258, and the waste toner fills these chambers from the one furthest to the left to the right. A detecting portion 262 is provided for the chamber furthest to the right to detect the point at which the waste toner box 216 is completely filled with the waste toner.

(Method for Positioning Processing Cartridge 5 Within Apparatus Main Body)

Figure 17:
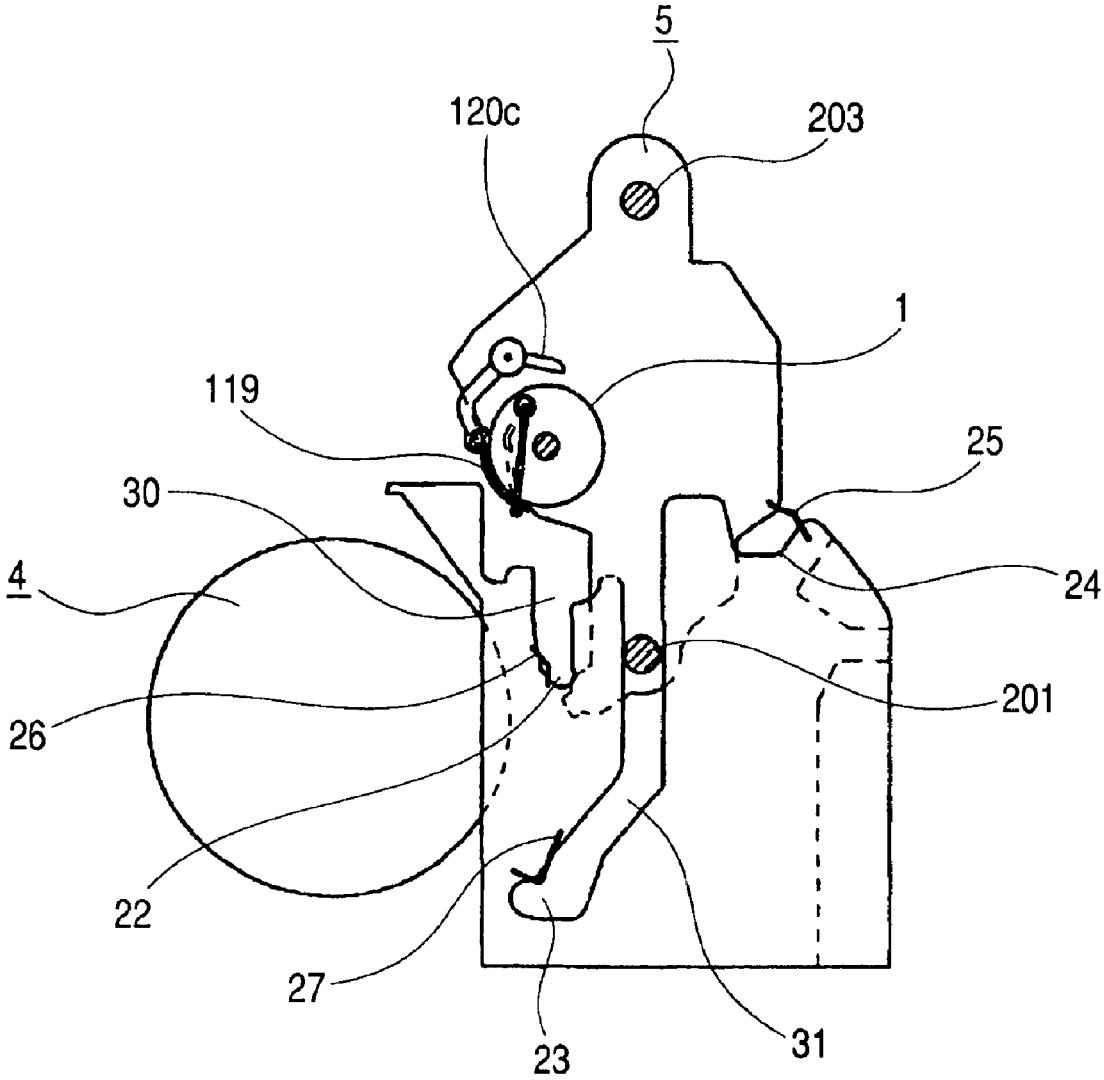
FIG. 17 is a diagram showing the arrangement for positioning the processing cartridge.

Referring to FIG. 17, an explanation will now be given for a method for detaching the processing cartridge 5 from a main body A of the image forming apparatus, and for positioning and fixing the processing cartridge 5 in a predetermined position. Inside the main body A, a guide rail 30 for the photosensitive drum 1 and a guide rail 31 for the intermediate transferring member are formed on two sides at different heights, and a positioning mechanism 24 is also provided. A supporting portion 22 for supporting the photosensitive drum bearing and a supporting portion 23 for supporting the bearing for the drive shaft of the intermediate transferring belt 5*a* are respectively arranged at the lower ends of the guide rails 30 and 31. Rotation force transmitting couplings are provided for the supporting portions 22 and 23, to transmit the rotational force to the photosensitive drum 1 and the intermediate transferring belt 5*a*, and as an upper lid 16 (see FIG. 2) of the main body A is opened, the couplings are disengaged and retracted in the axial direction. A system disclosed in JP-A-11-109836, for example, can be employed for the coupling retraction/engagement mechanism, and no further explanation for this will be given in this embodiment.

To insert the processing cartridge 5 into the main body A, the right bearing 106 and the left rotary shaft 102 of the photosensitive drum 1 are set up and slid along the guide rail 30, while the right bearing 205 and the left bearing 201 of the roller 240, for driving the intermediate transferring belt 5*a*, and the protrusions 203 and 204, which are formed on the left and right side plates 260 and 261, are lined up and positioned and slid along the guide rail 31. Then, the right bearing 106 and the left rotary shaft 102 of the photosensitive drum 102 drop to the supporting portion 22 and are secured by torsion coil springs 26. The right bearing 205 and the left bearing 201, of the driving roller 240 for the intermediate transferring belt 5*a*, drop to the supporting portion 23 and are secured by torsion coil springs 27. While the protrusions 203 and 204, formed on the side plates 260 and 261, drop to positioning grooves 24 and are pressed against and fixed to the main body frame of the apparatus by torsion coil springs 25.

(Preparative Rotation of Developing Roller 305)

The preparative rotation of the developing roller 305 will now be described. In this embodiment, the image forming processing is performed in the order yellow, magenta, cyan and black, and there is a feature that, following the reception by the image forming apparatus of image forming signals, the four developing rollers are rotated before the development, on the photosensitive drum 1, of the first electrostatic latent image (in this embodiment, yellow toner is used to develop the first electrostatic latent image). In this embodiment, four developing devices are employed; however, this embodiment can be applied for an apparatus that, at the least, includes a first developing device and a second developing device).

Figure 1:
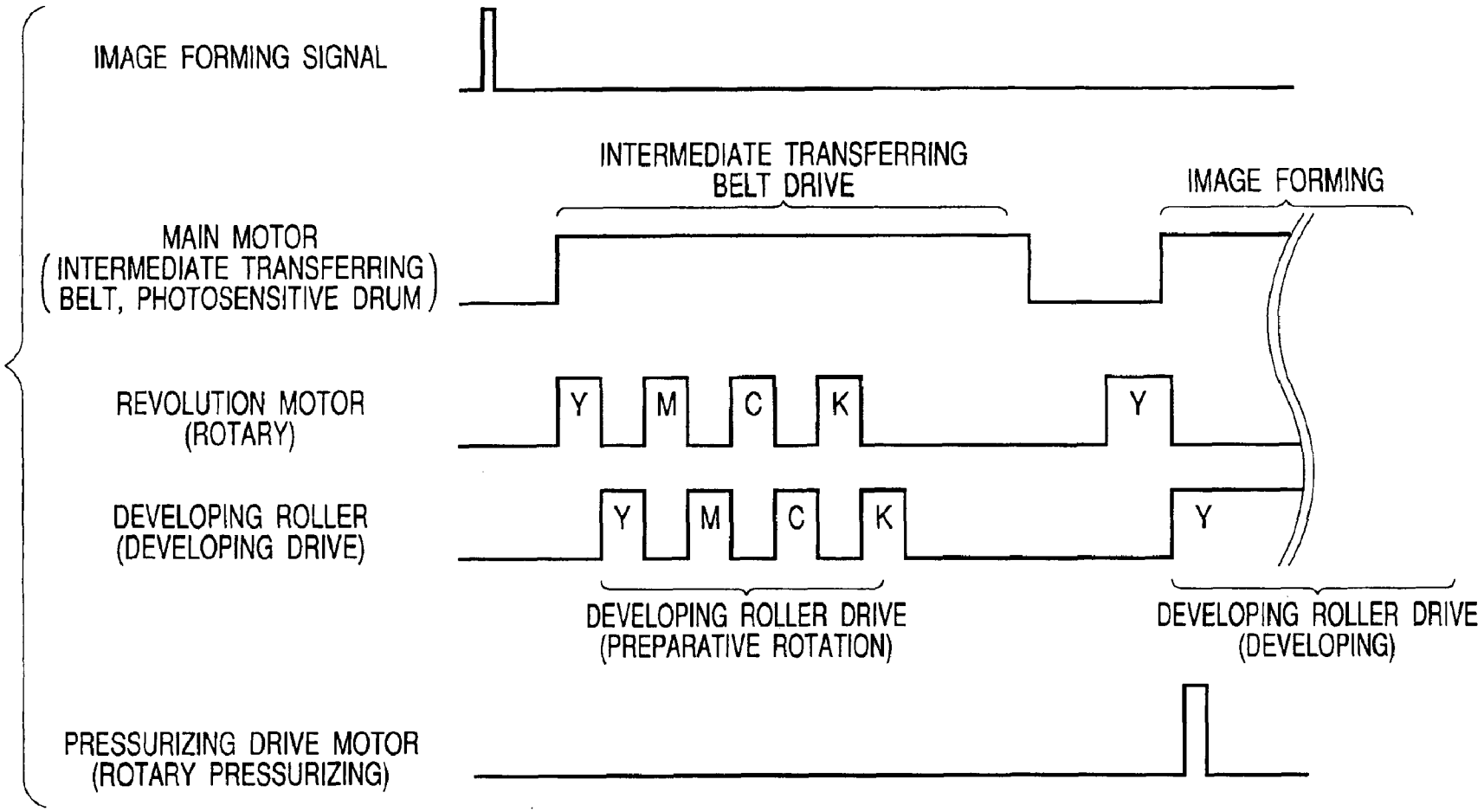
FIG. 1 is a diagram showing the timing for driving a developing roller according to one embodiment of the present invention.

For the image forming apparatus in this embodiment, as is shown in the timing chart in FIG. 1, the intermediate transferring belt 5*a* is idly rotated at least one cycle, during a period following the reception of an image forming signal, before the image forming processing is initiated (actually, before the first color developing process is performed), so that a marking (not shown) provided outside the image forming area of the intermediate transferring belt 5*a* can be detected.

As is described above, the rotary unit can be pivoted at the pivot shaft 60 between a first position, which is adjacent to the photosensitive drum 1, and a second position, which is separated from the photosensitive drum 1. During an operation for detecting a marking provided for the intermediate transferring belt 5*a* (the home position detection operation), the rotary unit at the second position, which is distant from the photosensitive drum 1, is rotated at the center shaft 51, conveys the developing cartridge 40Y, 40M, 40C or 40BK to the position whereat the cartridge engages the end gear 55, and is halted. When one developing cartridge 40 is halted, as is shown in FIG. 11, the input gear 307 and the end gear 55 engage and initiate the preparative rotation of the developing roller 305, which is a non-developing operation. Thereafter, the rotation of the end gear 55 is halted, while the rotary unit is revolved to convey the next developing cartridge 40 to the engagement position for the end gear 55. The same processing is repeated for the individual developing cartridges 40. In this case, the photosensitive drum 1 and the developing device do not contact each other, and therefore, the image developing process is not performed.

When the driving of the developing roller 305 (preparative rotation) is completed for each developing cartridge 40, the rotary unit is rotated, at the pivot shaft 60, to the first position that is adjacent to the photosensitive drum 1, and the first latent image developing operation is begun using the developing cartridge 40 (yellow cartridge) for the first color. In this embodiment, when the preparative rotations of all the developing rollers 305 have been completed, the developing cartridge 40 for the first color is again moved to the position whereat the end gear 55 is engaged, and when the rotation of the developing roller 305 is initiated for the first color, the rotary unit is driven, relative to the photosensitive drum 1, in the direction indicated by an arrow D in FIG. 11 (the rotary unit is moved from the second position to the first position). When the rotary unit is pivoted to the first position, the developing roller 305 is brought into contact with the photosensitive drum 1, and the latent image on the photosensitive drum 1 is developed.

When the developing process has been terminated, the developing cartridge 40 is separated from the photosensitive drum 1 and the rotary unit is revolved to move the next developing cartridge 40 to the developing position. Then, the same developing processing is performed for multi-color development.

Since a series of the above-described preparative rotations is performed for the developing roller 305 only upon the reception of a print signal, for continuous printing, for example, the preparative rotation is performed only once, immediately before the image forming performed for the first sheet. Therefore, compared with when the preparative rotation of the developing roller is performed each time before image development, image forming speed is not sacrificed. Further, since the preparative rotation is performed within the period during which the home position of the intermediate transferring belt 5*a* is detected, no time is sacrificed before the first sheet is printed out.

The preparative rotation may be less than one full rotation so long as the position can be changed whereat the developing blade 332 abuts upon the developing roller 305. That is, when the position whereat the developing blade 332 abuts upon the developing roller 305 for the first developing device is changed by the preparative rotation, the period for the preparative rotation of the developing roller for the second developing device and the revolution period of the rotary unit can be obtained before the developing of the first latent image is initiated by the first developing device. Therefore, the period required for the surface of the developing roller 305 to be recovered to the original state, with no blade print, can be acquired. This can be applied for the other developing rollers.

In this embodiment, since the distance required for the preparative rotation of the developing roller 305 is less than one rotation, the preparative rotations of all the developing rollers 305 can be completed within the period wherein the home position of the intermediate transferring belt 5*a* is detected.

In this embodiment, as is described above, upon the reception of an image forming signal, the preparative rotation is performed for all the developing rollers, before the first electrostatic latent image is developed. Therefore, by employing a simple configuration, the toner coated on the developing roller can be stabilized without image forming speed (printing time) being sacrificed.

Furthermore, since the above operation is performed in the period during which the marking provided for the outside of the image transferring area of the intermediate belt 5*a* is detected, without affecting the printing time, an appropriate developing roller driving period (preparative rotation period) can be obtained before the developing process is initiated. In addition, the toner coat on the developing roller that has not yet been developed can be stabilized, and the image forming process can be performed without the occurrence of a failure, such as an uneven image density.

Further, in this embodiment, the preparative rotations for all the developing rollers can be performed within a marking detection period for the intermediate transferring belt. The preparative rotation may also be performed, however, during a period extending from the reception of the image forming signal to the start of the image development, e.g., during the cleaning operation for the intermediate transferring belt. Also, the present invention is not limited to this embodiment, but can be variously modified without departing from the technical scope of the invention.

What is claimed is:

1. An image forming apparatus comprising:

an image bearing member;

first developing device, including a first developer carrying member, for developing a first latent image formed on said image bearing member;

second developing device including a second developer carrying member, for developing a second latent image formed on said image bearing member after said first developing device has developed the first latent image; and a rotary unit, for holding said first and said second developing device and for moving said first and said second developing device to a position opposite said image bearing member, wherein, upon the reception of an image forming signal at said image forming apparatus, said first and said second developer carrying members are rotated before the first latent image on said image bearing member is developed.

2. An image forming apparatus according to claim 1, wherein, when said first and said second developer carrying members are to be rotated before the development of the first latent image, positions for said first and said second developing device differ from those for the development of the latent images.

3. An image forming apparatus according to claim 2, wherein said rotary unit can be pivoted, at a shaft that is in parallel with a rotary shaft of said rotary unit and is not coaxial with the rotary shaft, to a first position that is adjacent to said image bearing member, and to a second position that is distant from said image bearing member; and wherein a position of said rotary unit is the second position when said first and said second developer carrying members are to be rotated before the development of the first latent image.

4. An image forming apparatus according to claim 2, further comprising:

a gear, located at a position, in a circumferential direction, of said rotary unit, for driving said first and said second developer carrying members, wherein, when said rotary unit is rotated, said first developer carrying member engages said gear and then said second developer carrying member engages said gear.

5. An image forming apparatus according to claim 1, wherein said first and said second developer carrying members are flexible rollers, and said first and said second developing device includes blades that abut upon said flexible rollers.

6. An image forming apparatus according to claim 1, wherein, when said first and said second developer carrying members are to be rotated before the development of the first latent image, a rotational distance for each of said first and said second developer carrying members is less than one rotation.

7. An image forming apparatus according to claim 1, further comprising:

an intermediate image bearing member for superimposing and holding first and second developer images that are formed on said image bearing member, before said first and said second developer images are transferred to a recording material, wherein, during a period for a detection of a home position of said intermediate image bearing member, said first and said second developer carrying members are rotated before the development of the first latent image.

* * * * *